US006047871A

United States Patent [19]

Chen

[11] Patent Number: 6,047,871

[45] Date of Patent: Apr. 11, 2000

[54] BRICK CUTTING APPARATUS

[76] Inventor: Lung-Chih Chen, No. 108, Sheng-Li 2nd St., Tantze Hsiang, Taichung County, Taiwan

[21] Appl. No.: 09/304,038

[22] Filed: May 4, 1999

[51] Int. Cl.[7] ..... B28D 1/32

[52] U.S. Cl. ..... 225/96.5; 225/96; 125/23.02; 83/886

[58] Field of Search ..... 225/96.5, 96; 125/23.02; 451/438; 83/886; 144/287

[56] References Cited

U.S. PATENT DOCUMENTS

| | | | |
|---|---|---|---|
| 5,040,445 | 8/1991 | Liou | 225/96.5 |
| 5,169,045 | 12/1992 | Liu | 125/23.02 |
| 5,331,877 | 7/1994 | Ishii | 125/23.02 |
| 5,480,081 | 1/1996 | Wilson et al. | 125/23.02 |
| 5,505,359 | 4/1996 | Joecker, Jr. | 225/96 |
| 5,560,274 | 10/1996 | Turner | 125/23.02 |
| 5,626,124 | 5/1997 | Chen | 125/23.02 |

*Primary Examiner*—Kenneth E. Peterson
*Assistant Examiner*—Sean Pryor
*Attorney, Agent, or Firm*—Rosenberg, Klein & Lee

[57] ABSTRACT

A brick cutting apparatus which includes a base frame, a cutter holder moved along a guide track at the base frame, a disk cutter and a stop plate respectively coupled to the cutter holder by a respective screw bolt, and a handle connected to the cutter holder and operated to move the cutter holder over the brick to be cut, wherein a carrier is coupled to a dovetail groove at one lateral side of the base frame to hold a supporting leg outside the base frame for supporting the brick to be cut on the base frame; the disk cutter has two reinforcing flanges raised from two opposite side walls thereof, and a bearing at a center through hole thereof which receives the corresponding screw bolt; a set of rubber packing blocks of different thickness are selectively fastened to the stop plate at a bottom side by a plug joint to adjust the vertical thickness of the stop plate subject to the thickness of the brick to be cut.

4 Claims, 4 Drawing Sheets

BRICK CUTTING APPARATUS

BACKGROUND OF THE INVENTION

The present invention relates to a brick cutting apparatus, and more particularly to such a brick cutting apparatus which enables the brick to be positively supported on a base frame for positive cutting by a disk cutter.

A regular brick cutting apparatus, as shown in FIGS. 1 and 2, comprises a base frame 10, a guide track 11 provided at the base frame 10 at the top, a straight bar 19 longitudinally provided at the base frame 10 at the bottom, an angled fender 12 at one side of the base frame 10, a slide 13 slidably mounted on the guide track 11, a cutter holder 14 pivoted to the slide 13, the cutter holder 14 having a locating frame 140, a handle 15 fixedly connected to the cutter holder 14, a disk cutter 16 fastened to the 15 cutter holder 14 by a screw bolt 17, and a stop plate 18 having a mounting portion 180 connected to the locating frame 140 at the cutter holder 14. When in use, the brick 2 to be cut is placed on the base frame 10 and stopped at the angled fender 12 between the straight bar 19 and the disk cutter 16, then the handle 15 is turned 20 downwards and pushed to move the slide 13 along the guide track 11, causing the disk cutter 16 to cut the brick 2. This structure of brick cutting apparatus is still not satisfactory in function. The drawbacks of this structure of brick cutting apparatus are outlined hereinafter.

1. With respect to durability and stability of the use of the disk cutter 16: As illustrated in FIGS. 2A and 2B, the disk cutter 16 is simply a thin, circular blade having a center through hole 160, which receives the screw bolt 17. Because no reinforcing means is provided to secure the connection between the disk cutter 16 and the screw bolt 17, the disk cutter 16 tends to be damaged, or forced to vibrate during a cutting operation.
2. During a big area cutting operation, as shown in FIG. 2A, a part of the brick 2 protrudes over one vertical side wall 1 of the base frame 10 (see FIG. 1), and is suspended in the air. Because the suspended part of the brick 2 has a weight, a downward pressure must be employed to a part of the brick 2 above the base frame 10, causing the brick 2 to be firmly held down for cutting, and preventing the brick 2 from falling out of the base frame 10.
3. Because the length of the mounting portion 180 of the stop plate 18 is not adjustable, the cutting angle of the disk cutter 16 and the pitch between the straight bar 19 and the disk cutter 16 can not be adjusted subject to the thickness of the brick to be cut.

SUMMARY OF THE INVENTION

The present invention has been accomplished to provide a brick cutting apparatus which eliminates the aforesaid drawbacks. According to one aspect of the present invention, a carrier is coupled to a dovetail groove at one lateral side of the base frame of the brick cutting apparatus to hold a supporting leg outside the base frame for supporting the brick to be cut positively on the base frame. According to another aspect of the present invention, the disk cutter has two reinforcing flanges raised from two opposite side walls thereof, and a bearing at a center through hole thereof which receives a screw bolt that supports the disk cutter on the cutter holder. According to still another aspect of the present invention, a set of rubber packing blocks of different thickness are provided for selectively fastening to the stop plate at the bottom by a plug joint, enabling the vertical thickness of the stop plate to be conveniently adjusted subject to the thickness of the brick to be cut.

DETAILED DESCRIPTION OF THE PREFERRED EMBODIMENT

Figure 1:
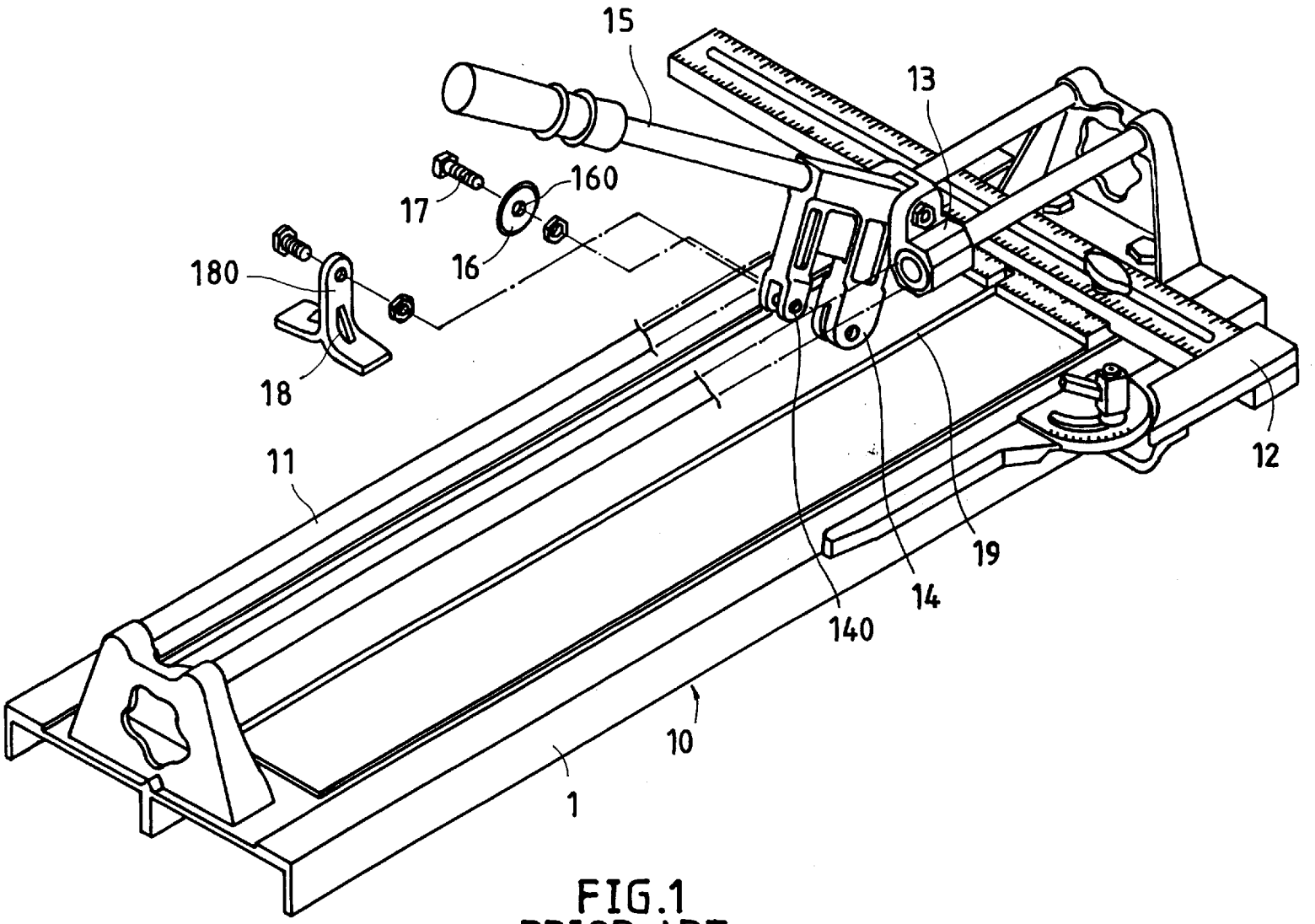
FIG.1 PRIOR ART
FIG. 1 is an exploded view of a brick cutting apparatus according to the prior art.
Figure 2A:
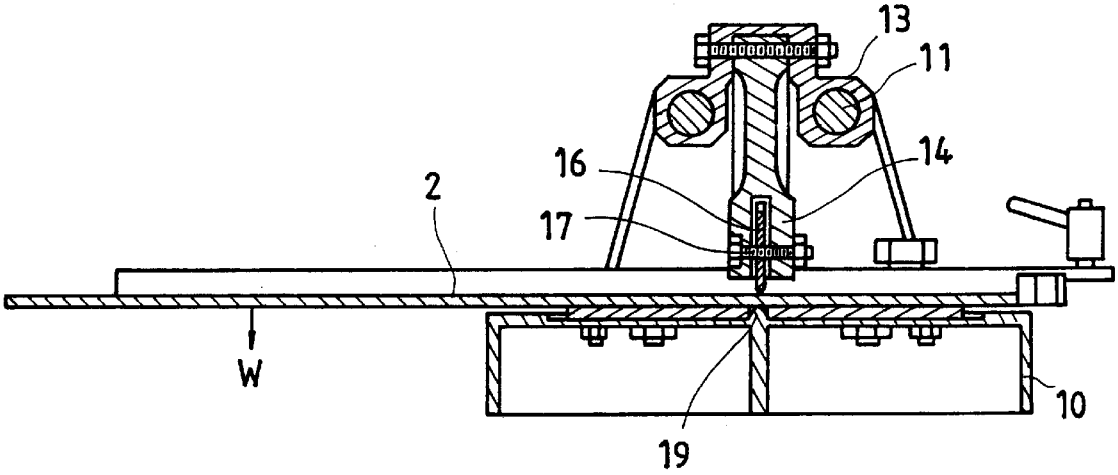
FIG. 2A PRIOR ART
FIG. 2A is an end view in section of the prior art cutting apparatus.
Figure 2B:
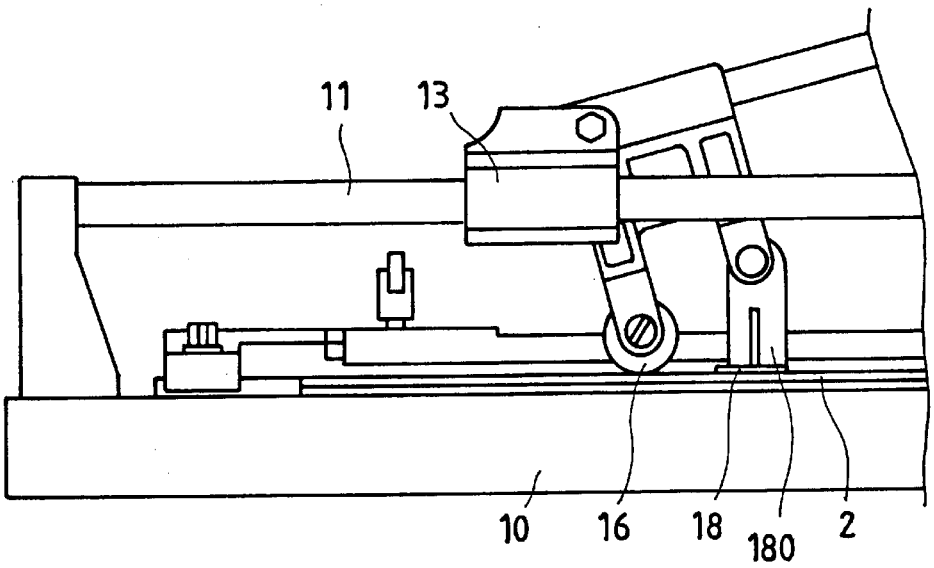
FIG. 2B PRIOR ART
FIG. 2B is a side plain view of a part of the prior art cutting apparatus.
Figure 3:
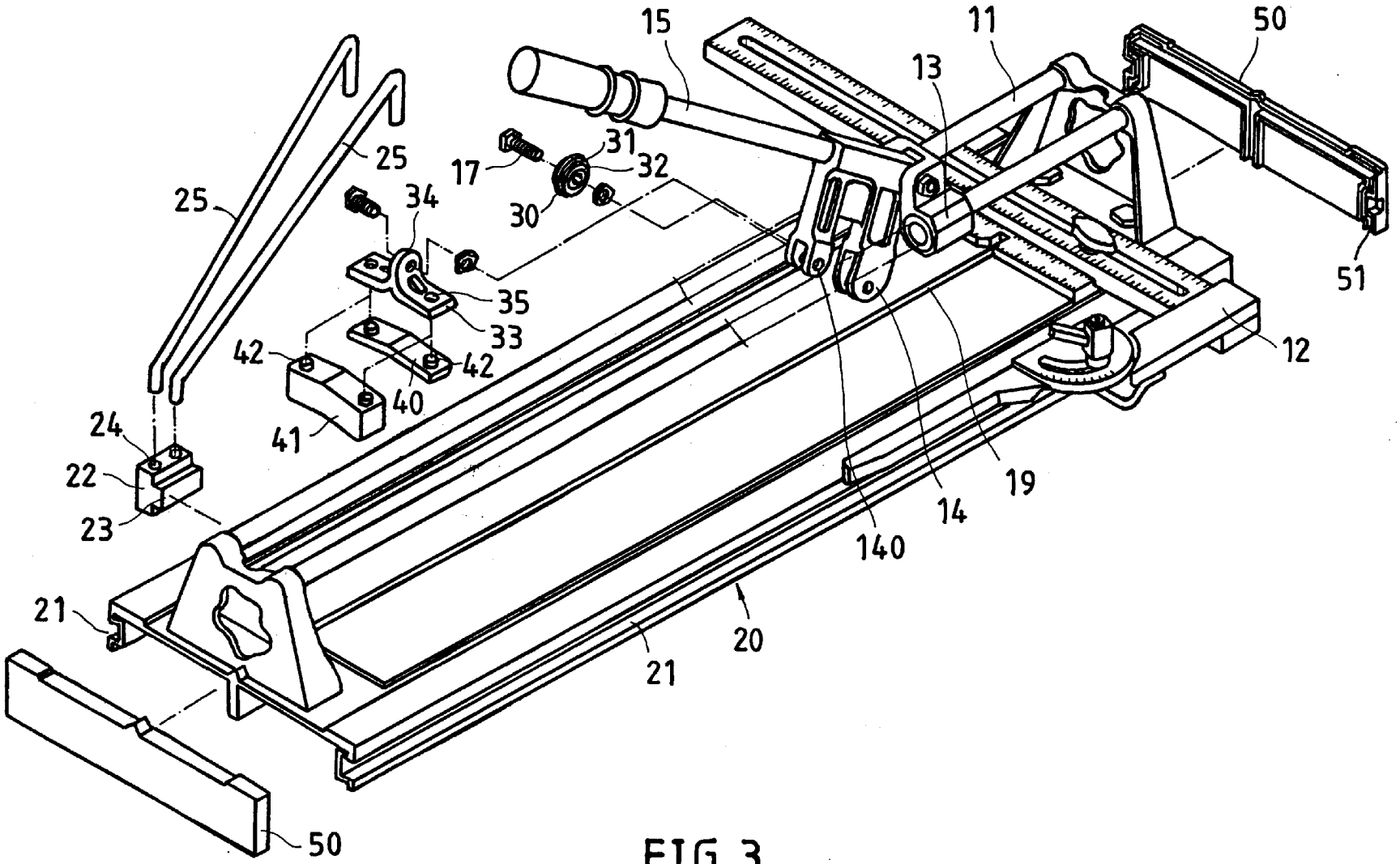
FIG. 3 is an exploded view of a brick cutting apparatus according to the present invention.

Referring to FIG. 3, a brick cutting apparatus is shown comprised of a base frame 20, a guide track 11 provided at the base frame 20 at the top, a straight bar 19 longitudinally provided at the base frame 20 at the bottom, an angled fender 12 at one side of the base frame 20, a slide 13 slidably mounted on the guide track 11, a cutter holder 14 pivoted to the slide 13, the cutter holder 14 having a locating frame 140, a handle 15 fixedly connected to the cutter holder 14 and operated to turn the cutter holder 14 relative to the slide 13 and to push the cutter holder 14 and the slide 13 along the guide track 11, a disk cutter 30 fastened to the cutter holder 14 by a screw bolt 17, and a stop plate 33 having an upright mounting portion 34 connected to the locating frame 140 of the cutter holder 14 at the bottom side.

Figure 4A:
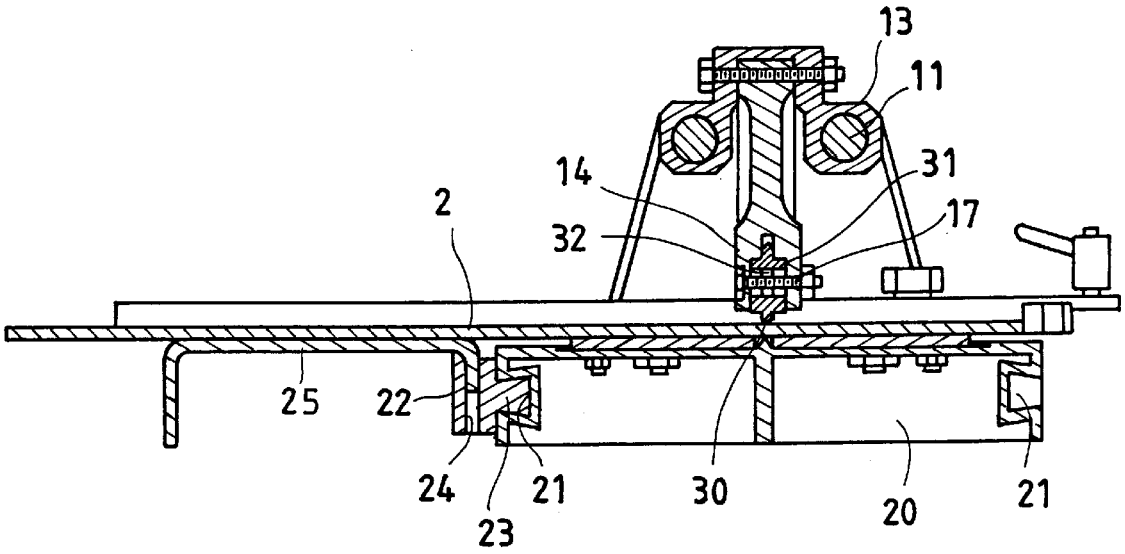
FIG. 4A is an end view in section of the cutting apparatus according to the present invention.
Figure 4B:
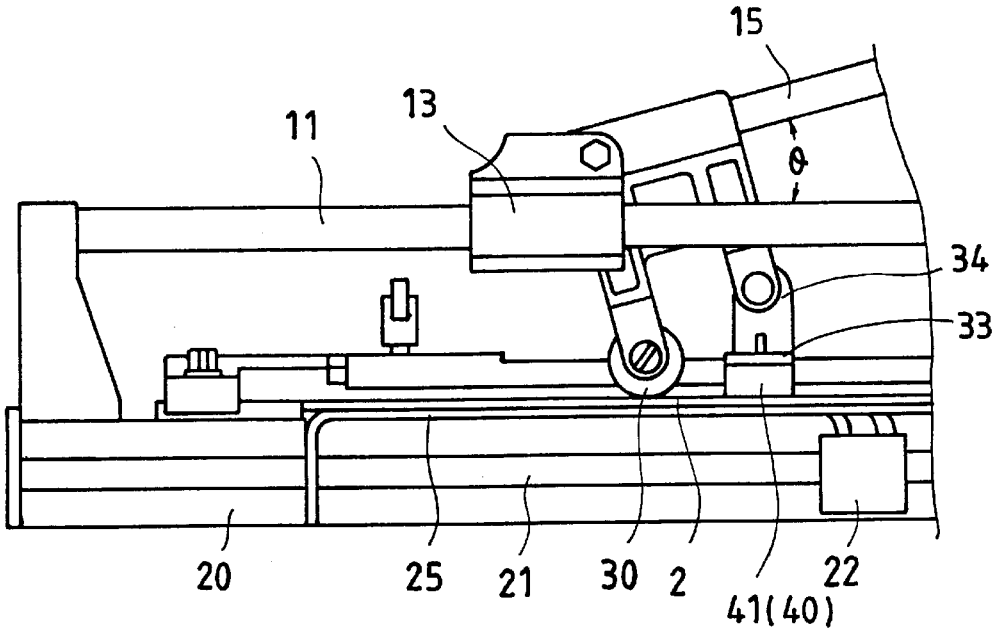
FIG. 4B is a side plain view of a part of the cutting apparatus according to the present invention.

Referring to FIGS. 4A and 4B and FIG. 3 again, the base frame 20 comprises two dovetail grooves 21 longitudinally provided at two opposite lateral side walls thereof. One carrier 22 is coupled to the base frame 20 at two opposite lateral sides. The carrier 22 comprises a dovetail block 23 coupled to one dovetail groove 21 at the base frame 20, and at least one for example two plug holes 24 at the top. Two supporting legs 25 are coupled to the plug holes 24 at the carrier 22, and longitudinally suspended at one side of the base frame 20 for supporting the brick positively in the cutting position. Two end blocks 50 are respectively fastened to two opposite ends of the base frame 20. The end blocks 50 each comprise two coupling grooves 51 respectively forced into engagement with the ends of the base frame 20. The disk cutter 30 comprises two reinforcing flanges 31 at its two opposite side walls, and a bearing 32 at its center through hole which receives the screw bolt 17. The stop plate 33 comprises a plurality of plug holes 35. A set of packing blocks 40 and 41 of different thickness are selectively fastened to the bottom side wall of the stop plate 33. The packing blocks 40 and 41 each comprise a plurality of plug pins 42 for press-fitting into the plug holes 35 at the stop plate 33.

Referring to FIG. 4A again, when cutting a big brick, the carrier 22 is coupled to the dovetail groove 21 at one lateral side of the base frame 20 and moved to the desired position, then one supporting leg 25 is fastened to the carrier 22 and horizontally supported on the floor on which the base frame 20 is supported for holding the brick positively in position for cutting. Because the brick is positively supported on the base frame 20 and the supporting leg 25, it can be accurately cut.

Referring to FIG. 4A again, because the disk cutter 30 has reinforcing flanges 31 at its two opposite side walls, and is supported on the screw bolt 17 by a bearing 32, the disk cutter 30 can be smoothly and positively rotated over the brick, causing the brick to be accurately cut.

Referring to FIG. 4B, because a set of packing blocks 40 and 41 of different thickness are provided for selectively fastening to the bottom side wall of the stop plate 33, the vertical thickness of the stop plate 33 can be adjusted subject to the wall thickness of the brick to be cut. The packing blocks 40 and 41 are preferably molded from rubber for positive positioning on the brick to be cut.

What the invention claimed is:

1. A brick cutting apparatus comprising a base frame, a guide track provided at said base frame at a top side, a straight bar longitudinally provided at said base frame below said guide track, an angled fender at one side of said base frame, a slide moved along said guide track, a cutter holder pivoted to said slide, said cutter holder having a locating frame, a handle fixedly connected to said cutter holder and operated to turn said cutter holder relative to the slide and to push said cutter holder and said slide along said guide track, a disk cutter fastened to said cutter holder by a screw bolt, and a stop plate having an upright mounting portion connected to said locating frame of said cutter holder at a bottom side, wherein said base frame comprises two dovetail grooves longitudinally provided at two opposite vertical side walls thereof, at least one carrier coupled to at least one of said dovetail grooves, and a supporting leg coupled to said carrier for supporting the brick to be cut on said base frame.

2. The brick cutting apparatus of claim 1 wherein said disk cutter comprises two reinforcing flanges raised from two opposite side walls thereof, and a bearing at a center through-hole thereof which receives said screw bolt.

3. The brick cutting apparatus of claim 1 wherein said stop plate comprises a plurality of plug holes, and a set of rubber packing blocks of different thickness are selectively fastened to said stop plate at a bottom side, said packing blocks each comprising a plurality of plug pins for press-fitting into the plug holes at said stop plate.

4. The brick cutting apparatus of claim 1 further comprising two end blocks respectively fastened to two opposite ends of said base frame, said end blocks each comprising two coupling grooves respectively forced into engagement with the ends of said base frame.

* * * * *